US009468818B2

(12) United States Patent
Nakamura

(10) Patent No.: US 9,468,818 B2
(45) Date of Patent: Oct. 18, 2016

(54) WOOD-TYPE GOLF CLUB HEAD

(71) Applicant: DUNLOP SPORTS CO. LTD., Kobe-shi, Hyogo (JP)

(72) Inventor: Hirotaka Nakamura, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/426,966

(22) PCT Filed: Oct. 10, 2013

(86) PCT No.: PCT/JP2013/077632
§ 371 (c)(1),
(2) Date: Mar. 9, 2015

(87) PCT Pub. No.: WO2014/061560
PCT Pub. Date: Apr. 24, 2014

(65) Prior Publication Data

US 2015/0238827 A1 Aug. 27, 2015

(30) Foreign Application Priority Data

Oct. 17, 2012 (JP) ..... 2012-230147

(51) Int. Cl.
*A63B 53/04* (2015.01)

(52) U.S. Cl.
CPC ..... *A63B 53/0466* (2013.01); *A63B 53/04* (2013.01); *A63B 2053/045* (2013.01); *A63B 2053/0408* (2013.01); *A63B 2053/0437* (2013.01); *A63B 2060/002* (2015.10)

(58) Field of Classification Search
CPC ..... A63B 2053/0437; A63B 2060/002; A63B 53/0466; A63B 53/04
USPC ..... 473/332, 346, 341, 345
See application file for complete search history.

(56) References Cited

U.S. PATENT DOCUMENTS

| | | | | |
|---|---|---|---|---|
| 7,303,488 | B2 * | 12/2007 | Kakiuchi | A63B 53/0466 473/345 |
| 8,231,481 | B2 * | 7/2012 | Takechi | A63B 53/0466 473/342 |
| 2005/0124436 | A1 | 6/2005 | Kakiuchi et al. | |
| 2007/0049407 | A1 * | 3/2007 | Tateno | A63B 53/0466 473/345 |
| 2010/0048324 | A1 * | 2/2010 | Wada | A63B 53/0466 473/346 |
| 2010/0120556 | A1 | 5/2010 | Yamamoto et al. | |

(Continued)

FOREIGN PATENT DOCUMENTS

| | | |
|---|---|---|
| JP | 2003-47676 A | 2/2003 |
| JP | 2005-168665 A | 6/2005 |

(Continued)

*Primary Examiner* — Benjamin Layno
(74) *Attorney, Agent, or Firm* — Birch, Stewart, Kolasch & Birch, LLP

(57) ABSTRACT

A wood golf club head, which is provided therein with a hollow section and for which a crown section that forms the upper surface of the head is formed from a metal material. The crown section includes a heel portion; a toe portion with a smaller thickness than the heel portion; and a thickness transition section provided between the heel portion and the toe portion, the thickness of which decreases gradually from the heel portion to the toe portion. In the top view of a reference state in which the head is placed on a horizontal plane with a specified lie angle and loft angle, the thickness transition section extends as a smooth curve that protrudes towards the toe side.

22 Claims, 13 Drawing Sheets

(56) References Cited

U.S. PATENT DOCUMENTS

| | | | | |
|---|---|---|---|---|
| 2011/0021289 | A1 | 1/2011 | Yokota | |
| 2011/0312439 | A1 | 12/2011 | Hayase et al. | |
| 2015/0045147 | A1* | 2/2015 | Abe | A63B 53/04 473/345 |

FOREIGN PATENT DOCUMENTS

| | | | |
|---|---|---|---|
| JP | 2010-46338 | A | 3/2010 |
| JP | 2010-115334 | A | 5/2010 |
| JP | 2011-24649 | A | 2/2011 |
| JP | 2012-272 | A | 1/2012 |

* cited by examiner

Section A - A

WOOD-TYPE GOLF CLUB HEAD

TECHNICAL FIELD

The present invention relates to a wood-type golf club head that may offer low pitch hitting sound which is desired by professional golfers and advanced golfers.

BACKGROUND ART

Recent years, various types of wood-type golf club heads having a main portion made of metallic material have been proposed. These golf club heads have a hollow therein to offer a large head volume, low center of gravity, high moment of inertia and high flexibility for designing weight distribution. Thus hollow metal wood-type golf club heads may offer a lot of merits.

The above-mentioned golf club heads generally tend to produce loud and high pitch hitting sound when hitting a golf ball. On the other hand, traditional solid wood-type golf club heads made of a woody material tend to produce low pitch and quiet hitting sound.

In general, professional golfers and advanced golfers tend to desire traditionally low-pitch and quiet hitting sound. In many cases, the hitting-sound is one of the important factors for ensuring better golf swings, and may also affect the results of the golf play. Accordingly, a golf club head that may offer low pitch and quiet hitting sound has been desired in order to satisfy the professional golfers and advanced golfers.

RELATED ART DOCUMENTS

Patent Documents

[Patent Document 1] Japanese Unexamined Patent Application Publication 2012-272

[Patent Document 2] Japanese Unexamined Patent Application Publication 2011-24649

[Patent Document 3] Japanese Unexamined Patent Application Publication 2010-115334

SUMMARY OF THE INVENTION

Problem to be Solved by the Invention

When hitting a golf ball, each portion of a hollow wood-type golf club head vibrates. In particular, the wood-type golf club head having a thin crown portion may cause large vibration on the crown portion.

The inventors conducted a vibration analysis of hollow wood-type golf club heads under the primary natural vibration mode. As a result, the antinode (A) of vibration which is the maximum amplitude area of the vibration is appeared on its heel side of the crown portion of the club head (a) as shown in FIG. 5. In addition, it was confirmed that the amplitude of the vibration gradually and concentrically decreases toward outwardly from the antinode (A) of vibration.

The pitch, which is closely related to frequency, of a sound is almost determined by the speed of the vibration. For example, the faster vibration, the higher the tone becomes. Accordingly, in order to obtain low pitch hitting sound, it is important to make the crown portion vibrate more slowly so as to have low vibration frequency. Thus a crown structure that vibrates easily and may transfer the vibration to the whole of the crown portion may be preferred.

In addition, a loudness (pressure) of sound is almost determined by the level of vibration. For example, the larger amplitude, the louder the sound becomes. Accordingly, in order to obtain a small hitting sound, it is important to reduce the sound pressure by offering a thicker crown portion so that it vibrates with small amplitude.

Unfortunately, when the whole of the crown portion has a larger thickness, such a golf club head tends to have high center of gravity.

The present invention has been worked in light of the circumstance described above, and it is an object thereof to provide a wood-type golf club head that may offer low pitch and quiet hitting sound with a low center of gravity.

Means for Solving the Problem

According to one aspect of the present invention, a wood-type golf club head having a hollow therein, the club head includes a crown portion forming a top surface of the head being made of metallic material. The crown portion includes a heel-side portion, a toe-side portion having a thickness smaller than that of the heel-side portion and a thickness transition portion provided between the toe-side portion and the heel-side portion and having a thickness gradually decreasing from the heel-side portion to the toe-side portion. The thickness transition portion extends in a curved manner that smoothly protrudes toward a toe of the club head in a plan view of the club head under a standard condition in which the club head is placed on a horizontal plane with its lie angle and its loft angle.

In the wood-type golf club head in according with the present invention, the thickness transition portion preferably extends in an arc shape in the plan view.

In the wood-type golf club head in according with the present invention, the thickness transition portion is preferably located in a toe side of a center of gravity of the head in the plan view.

In the wood-type golf club head in according with the present invention, the heel-side portion preferably has a thickness t1 in a range of from 0.6 to 1.1 mm, and the toe-side portion preferably has a thickness t2 in a range of from 0.3 to 0.9 mm.

In the wood-type golf club head in according with the present invention, the difference t1−t2 between a thickness t1 of the heel-side portion and a thickness t2 of the toe-side portion is preferably in a range of from 0.05 to 0.8 mm.

In the wood-type golf club head in according with the present invention, the thickness transition portion preferably has a width in a range of from 2 to 10 mm in the plan view.

In the wood-type golf club head in according with the present invention, the thickness transition portion preferably extends in an arc manner having a radius of curvature in a range of from 30 to 110 mm in the plan view.

In the wood-type golf club head in according with the present invention, a ratio Ah/At of an area Ah of the heel-side portion to an area At of the toe-side portion is in a range of from 0.70 to 5.0.

Effect of the Invention

In a primary natural vibration mode, a hollow wood-type golf club head having a thin crown portion typically has an antinode of vibration, which is the region of maximum amplitude, on its heel side of the crown portion. The club head in accordance with the present invention comprises a heel-side portion having a relatively large thickness on the heel side of the crown portion where the antinode of vibration may appear. Since the heel-side portion of the crown portion has relatively high rigidity, vibration (amplitude) thereon may be reduced. Thus the wood-type golf club head in accordance with the present invention may produce hitting sound with low sound pressure.

In addition, the wood-type golf club head in accordance with the present invention comprises a toe-side portion on its toe side of the crown portion, wherein the toe-side portion has a thickness smaller than that of the heel-side portion. Thus an increase of mass of the crown portion may be prevented, thereby offering a low center of gravity of the head. Since the toe side of the crown portion is positioned far away from the antinode of vibration, the amplitude thereon is typically small. Although the toe-side portion has a small thickness, vibration of the crown portion does not become large. Thus an increase of sound pressure of the hitting sound may be prevented.

The wood-type golf club head in accordance with the present invention comprises a thickness transition portion arranged between the heel-side portion and the toe-side portion of the crown portion, wherein the thickness transition portion has a thickness gradually decreasing from the heel-side portion to the toe-side portion. The thickness transition portion extends in a curved manner that smoothly protrudes toward the toe of the club head in a plan view of the club head under a standard condition in which the club head is placed on a horizontal plane with its lie angle and its loft angle. Such configuration of the thickness transition portion may smoothly transfer the vibration spreading from the antinode at the heel side of the crown portion to the toe-side portion. Thus the crown portion may vibrate in low frequency, thereby producing low pitch hitting sound.

As described above, the golf club head in accordance with the present invention may produce low pitch hitting sound while offering low center of gravity of the head.

MODE FOR CARRYING OUT THE INVENTION

Figure 1:
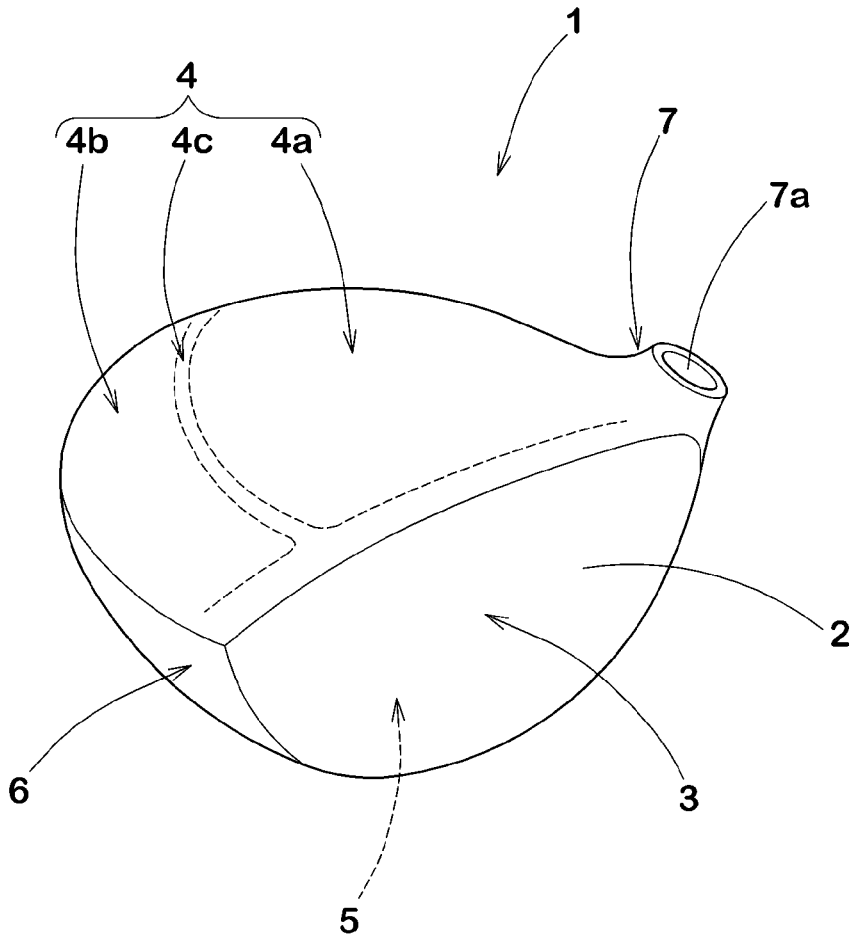
FIG. 1 is a perspective view of a wood-type golf club head in accordance with an embodiment of the invention.
Figure 2:
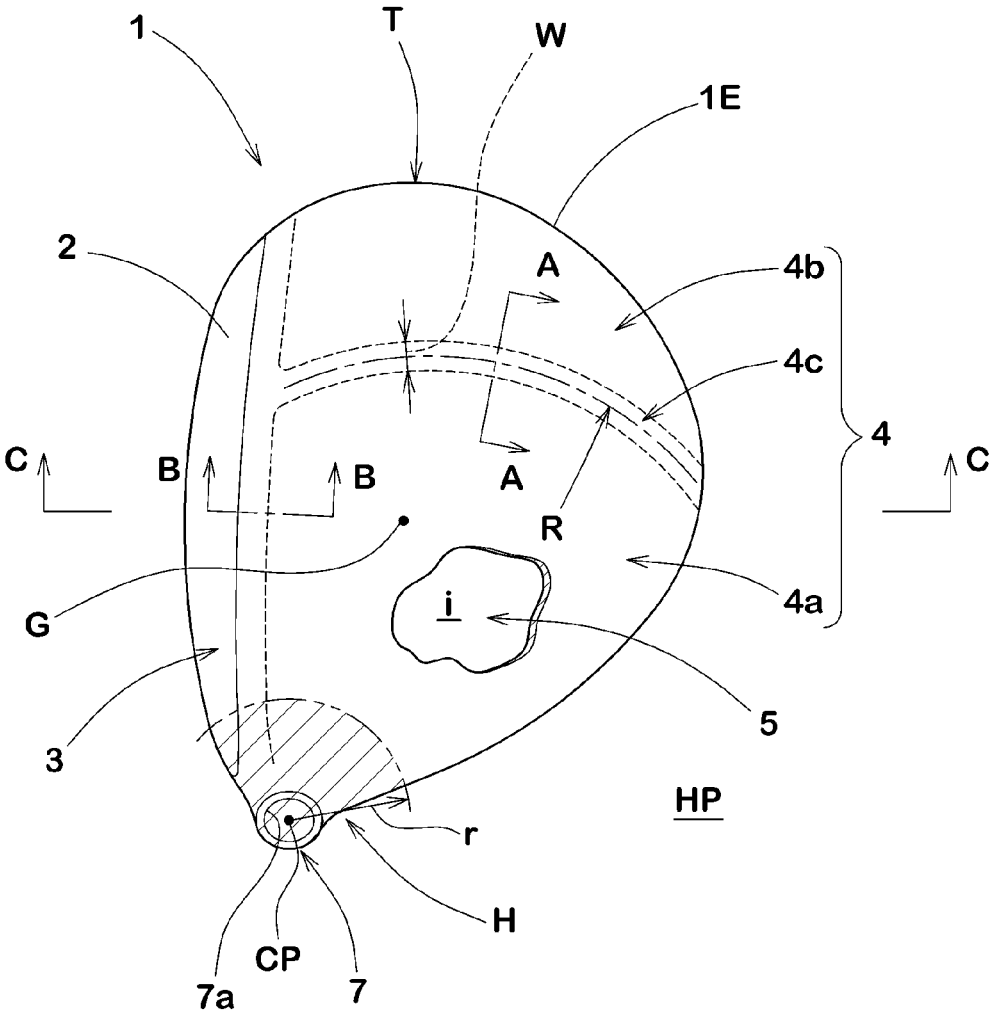
FIG. 2 is a plan view of the wood-type golf club head of FIG. 1 under a standard condition.

An embodiment of the present invention will be explained below with reference to the accompanying drawings. FIG. 1 illustrates a perspective view of a wood-type golf club head (hereinafter it may be referred as "club head" or "head") 1 in accordance with the present embodiment, FIG. 2 illustrates a plan view of the head under a standard condition, and FIG. 3 illustrates a cross sectional view of the head taken along lines C-C of FIG. 2.

Here, the standard condition of the head 1 means a condition where the club head 1 is placed on a horizontal plane HP with its lie angle and its loft angle. Through this disclosure, the club head 1 is supposed to be kept in the standard condition unless otherwise noted.

Figure 3:
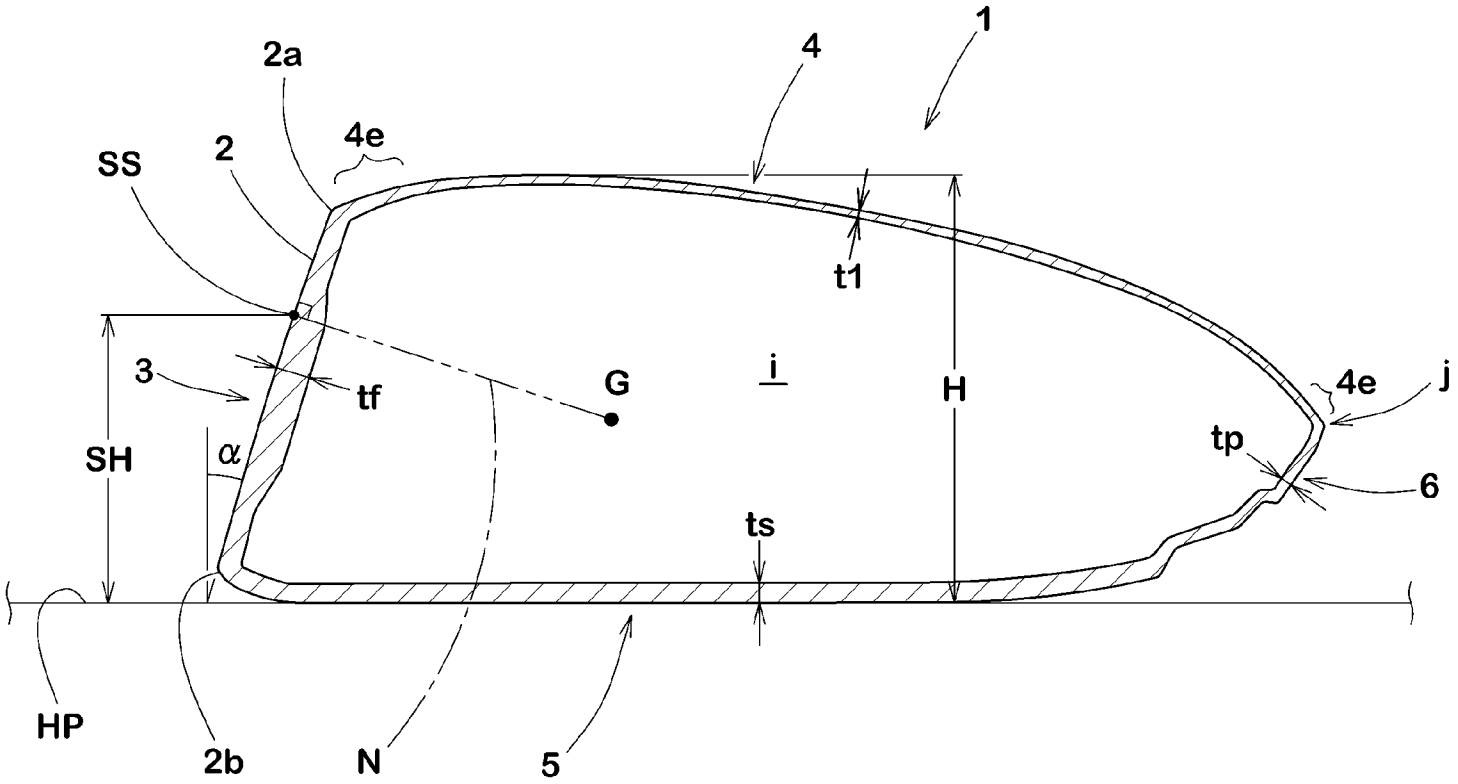
FIG. 3 is a cross sectional view taken along lines C-C of FIG. 2.

As shown in FIG. 3, the club head 1 comprises a hollow portion (i) therein. The major part of the hollow portion (i) is a void filled by a gas. In another aspect, a weight adjustment member, e.g. a gel may be arranged in the hollow portion (i).

The wood-type golf club head typically includes both kinds of driver head (#1) and fairway wood head. Through this disclosure, the concept of the wood-type golf club head further includes a kind of utility-type head having the different club name and numbers from those, and in particular the wood-type golf club head preferably has a loft angle $\alpha$ (shown in FIG. 3) in a range of from 8 to 25 degrees.

Preferably, the club head 1 has a volume in a range of not less than 90 $cm^3$, more preferably not less than 110 $cm^3$ in order to offer a high moment of inertia and a deep depth of center of gravity. On the other hand, the club head 1 preferably has the volume in a range of not more than 460 $cm^3$, more preferably not more than 450 $cm^3$ in order to prevent an increase of remarkable mass of the head while keeping the golf rules.

Preferably, the club head 1 has a mass in a range of not less than 160 g, more preferably not less than 170 g, but preferably not more than 250 g, more preferably not more than 240 g for better golf swings.

The wood-type golf club head 1 shown in FIGS. 1 to 3 is embodied as a fairway wood head which comprises a face portion 3 for hitting a ball, a crown portion 4 forming a top surface of the head, a sole portion 5 forming a bottom surface of the head, a side portion 6 connecting between the crown portion 4 and the sole portion 5, and a hosel portion 7 having a shaft insertion hole 7*a* for which a club shaft (not shown) to be inserted.

Each part of the club head 1 is made of a metallic material. For example, each of the face portion 3, the crown portion, the sole portion 5, side portion 6 and the hosel portion 7 is made of a metallic material. For example, the metallic material for forming the club head 1 may be employed stainless steel, a maraging alloy, a titanium alloy or the like.

The club head 1 may be configured using two kinds of metallic material having different specific gravity in order to optimize a location of the center G of gravity of the head. A fiber reinforcing resin may further be employed at a part of the head 1. However, the crown portion 4 should be formed of a metallic material to improve the hitting sound of the club head 1. In this disclosure, the crown portion 4 is made of one kind of metallic material having a certain specific gravity.

The face portion 3 is required to have enough strength to resist impact when hitting a golf ball. In view of the above, the thickness tf of the face portion 3 is preferably set in a range of from 2.0 to 4.0 mm.

The sole portion 5 may come into contact with the ground when swinging a golf club. Thus the sole portion 5 is also required to have enough strength. In view of the above, the thickness ts of the sole portion 5 is in a range of from 0.6 to 10.0 mm, for example.

Preferably, the side portion 6 has a thickness tp in a range of from 0.6 to 4.0 mm in order to achieve lightening of the club head 1 as well as to offer high moment of inertia around the vertical axis passing through the center G of gravity of the head.

Figure 4A:
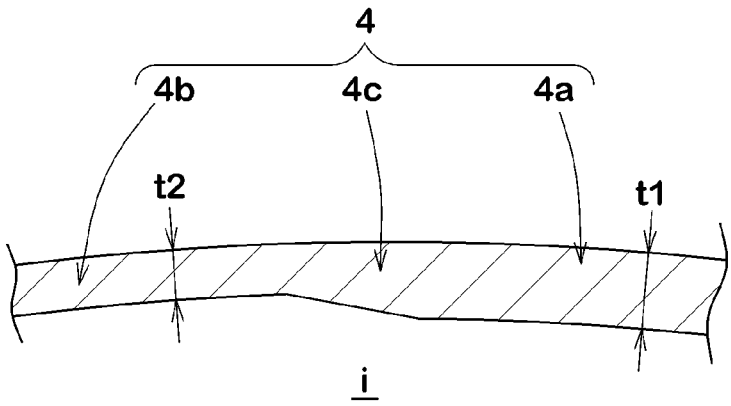
FIG. 4A is a cross sectional view taken along a line A-A of FIG. 2.
Figure 4B:
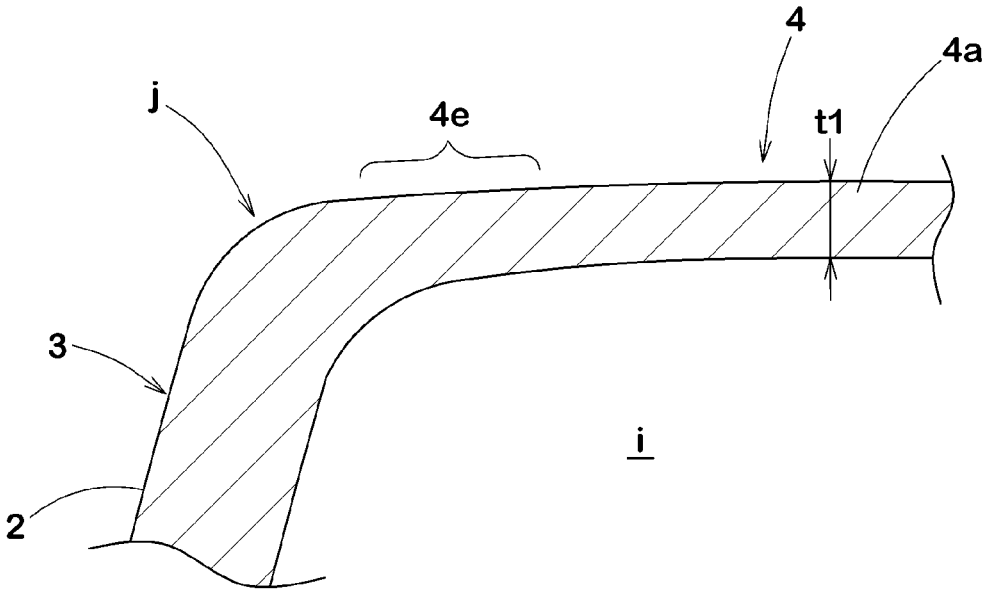
FIG. 4B is a cross sectional view taken along a line B-B of FIG. 2.

FIGS. 4A and 4B illustrate cross sectional views taken along lines A-A and B-B of FIG. 2, respectively. As shown in FIGS. 2, 4A and 4B, the crown portion 4 comprises a heel-side portion 4*a*, a toe-side portion 4*b* having a thickness smaller than that of the heel-side portion 4*a*, and a thickness transition portion 4*c* arranged between the heel-side portion 4*a* and the toe-side portion 4*b* with a thickness gradually decreasing from the heel-side portion 4*a* to the toe-side portion 4*b*. The thickness transition portion 4*c* extends in a curved manner that smoothly protrudes toward a toe T of the club head 1 in the plan view of the club head 1 under the standard condition as shown in FIG. 2.

The club head 1 in accordance with the present embodiment may produce low pitch and quiet hitting sound when hitting a golf ball. The reasons are as follows.

The inventors analyzed a primary natural vibration mode of various kinds of metal hollow wood-type golf club heads through a computer simulation based on the finite element method. Following is a representative club head specification.

Head volume: 130 to 370 $cm^3$

Head mass: 180 to 230 g

Head material: Titanium alloy, maraging alloy or the like

Thickness of face portion: 2.0 to 4.0 mm

Thickness of sole portion: 1.0 to 8.0 mm

Thickness of side portion: 1.0 to 4.5 mm

Thickness of crown portion: 0.4 to 1.5 mm

Results of the simulation of the primary natural vibration mode, it was confirmed that the respective crown portions of wood-type golf club heads as mentioned above were the largest vibrating portion. That could be happened since the thicknesses of crown portions of the club heads were thin. The inventors researched in view of the fact that vibration of the crown portion largely affects hitting sound of the club head. As a result of the intensive research, the inventors have found that conventional high pitch hitting sound would be improved by controlling vibration of the crown portion.

Figure 5:
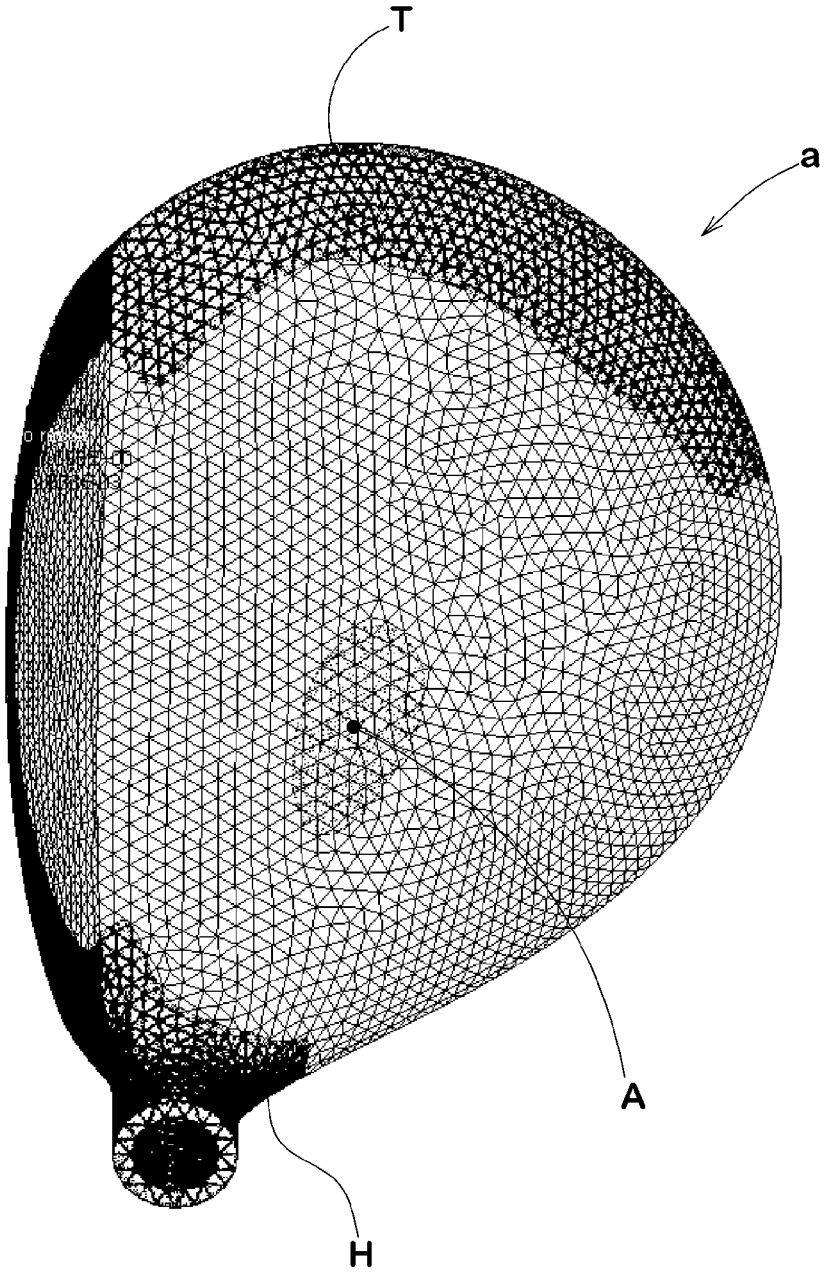
FIG. 5 is a plan view of the club head showing analysis results of a primary natural vibration mode of the club head through a computer simulation.

FIG. 5 illustrates a plan view of a club head showing analysis results of the primary natural vibration mode of the club head through the computer simulation. In FIG. 5, the size of amplitude is rendered in gradation. Referring to FIG. 5, the antinode (A) of vibration where the maximum amplitude of the vibration is, in the primary natural vibration mode, appeared on its heel side of the crown portion of the club head (a). It is observed that vibration of the crown portion is transferred outwardly from the antinode (A) in concentrically with the outline shape of the crown portion which is shaped in a vertically long elliptic. The reason that the position of antinode (A) appears on the side of heel side of the crown portion 4 is not clear. It may depend on the traditional wood-type golf club head shape like a pear.

The golf club head in accordance with the present invention, as shown in FIG. 2, comprises the heel-side portion 4*a* having a relatively large thickness on its heel H side so as to include the location of the antinode. Accordingly, the heel-side portion 4*a* of the crown portion 4 is enhanced in rigidity so as to vibrate with small amplitude. Thus the club head 1 may produce hitting sound with small sound pressure.

Next, the club head 1 in accordance with the present invention comprises the toe-side portion 4*b* having a relatively small thickness on its toe T side of the crown portion 4. This may prevent an increase of the whole mass of the crown portion 4, thereby offering low center G of gravity of the head. In addition, a portion of the toe T side, which is located far away from the antinode (A), in the crown portion 4 typically vibrates in small amplitude. Accordingly, although the toe-side portion 4*b* has a small thickness, it may prevent an increase of sound pressure of the hitting sound.

In addition, the club head 1 in accordance with the present invention, as shown in FIG. 4A, comprises a thickness transition portion 4*c* arranged between the heel-side portion 4*a* and the toe-side portion 4*b* of the crown portion 4, wherein thickness transition portion 4*c* has a thickness gradually decreasing from the heel-side portion 4*a* to the toe-side portion 4*b*. Since the thickness transition portion 4*c* has a smoothly changing thickness, no abrupt rigidity difference is provided between the toe-side portion 4*a* and the heel-side portion 4*b*. In addition, the thickness transition portion 4*c* curves along with the contour of the amplitude that spreads from the antinode (A) on the heel side of the crown portion 4.

The thickness transition portion 4*c* may smoothly transfer the vibration spread from the heel-side portion 4*a* where the antinode tends to appear, to the toe-side portion 4*b*. Accordingly, the crown portion 4 that may easily vibrate is offered. Thus, the frequency of the vibration generated from the crown portion 4 when hitting may become lower, thereby lowering the hitting sound.

As described above, the club head 1 in accordance with the invention may produce low pitch and quiet hitting sound while having low center G of gravity of the head.

As shown in FIG. 3, the club head 1 having the low center G of gravity has a low sweet spot height SH. The sweet spot height SH is a vertical height from the horizontal plane HP to the sweet spot SS of the head under the standard condition. The sweet spot SS is defined as the point of intersection of the face 2 and the normal N to the face 2 extending from the center G of gravity. The club head 1 having a low sweet spot height SH may offer many opportunities to hit a golf ball at a portion upper than the sweet spot SS of the face 2. Thus, the amount of back spin of hit ball may be reduced so that the flight distance of hit ball enlarges.

When the club head 1 is embodied as a driver head, the sweet spot height SH is preferably set in a range of from 30 to 40 mm. When the club head 1 is embodied as a fairway wood head, the sweet spot height SH is preferably set in a range of from 20 to 30 mm.

As shown in FIG. 2, the crown portion 4, for example, may essentially consist of three portions of the heel-side portion 4*a*, the toe-side portion 4*b* and the thickness transition portion 4*c* in a plan view of the head under the standard condition. The crown portion 4, as shown in FIG. 4B, may further comprise a crown periphery portion 4*e* having a thickness gradually changing within the limited area at the side of a corner J between the face portion 3 and the crown portion 4. In addition, the crown portion 4, as shown in FIG. 3, may further comprise a crown periphery portion 4*e* having a thickness gradually changing within the limited area at the side of a corner J between the side portion 6 and the crown portion 4. In this embodiment, the crown portion 4 of the club head 1 in accordance with the present embodiment essentially consist of the three portions of the heel-side portion 4*a*, the toe-side portion 4*b* and the thickness transition portion 4*c* except for the crown periphery portion 4*e*.

Preferably, the heel-side portion 4*a*, in the plan view of FIG. 2, is formed to have an area greater than that of the toe-side portion 4*b*. This configuration may ensure the hitting sound with small sound pressure. Here, for convenience, the respective areas described above are defined as the respective flat areas projected on to the horizontal plane HP of FIG. 2.

Referring to FIG. 4A, although the thickness t1 of the heel-side portion 4*a* is not particularly limited, when it is excessively small, the sound pressure of the hitting sound may not be lowered. Preferably, the thickness t1 of the heel-side portion 4*a* is in a range of not less than 0.6 mm, more preferably not less than 0.7 mm, still further preferably not less than 0.8 mm. On the other hand, when the thickness t1 of the heel-side portion 4*a* is excessively large, it may be difficult to offer low center G of gravity. Preferably, the thickness t1 of the heel-side portion 4*a* is in a range of not more than 1.1 mm, more preferably not more than 1.0 mm, still further preferably not more than 0.9 mm. In this embodiment, the heel-side portion 4*a* is formed as a constant thickness.

Although the thickness t2 of the toe-side portion 4*b* is not particularly limited, when it is excessively small, endurance of the crown portion 4 may be deteriorated. Preferably, the thickness t2 of the toe-side portion 4*b* is in a range of not less than 0.3 mm, more preferably not less than 0.4 mm, still further preferably not less than 0.5 mm. On the other hand, the thickness t2 of the toe-side portion 4*b* is excessively large, it may be difficult to offer low center G of gravity. Preferably, the thickness t2 of the toe-side portion 4*b* is in a range of not more than 0.9 mm, more preferably not more than 0.8 mm, still further preferably not more than 0.7 mm. In this embodiment, the toe-side portion 4*b* is also formed as a constant thickness.

The difference t1−t2 between the thickness t1 of the heel-side portion 4*a* and the thickness t2 of the toe-side portion 4*b* is not limited, but is preferably in a range of not less than 0.05 mm, more preferably not less than 0.1 mm, but preferably not more than 0.8 mm, more preferably not more than 0.6 mm in order to further improve the advantage above.

The embodiment illustrated in FIG. 2, the thickness transition portion 4*c* extends rearward of the head from the side of the face 2 so as to divide the crown portion 4 into two portions of the heel-side portion 4*a* and the toe-side portion 4*b* in the plan view of the head 1. The thickness transition portion 4*c* has one end positioned at the front side of the crown portion 4 and the other end positioned at the rear side of the crown portion 4.

In the plan view of the head, the thickness transition portion 4*c* preferably has a width W in a range of not less than 2 mm, more preferably not less than 4 mm. When the width W of the thickness transition portion 4*c* is small, undesirable rigidity difference between the heel-side portion 4*a* and the toe-side portion 4*b* may be formed. Such rigidity difference may cause not only lowering of durability of the crown portion 4 but also interrupting vibration transmission. On the other hand, when the width W of the thickness transition portion 4*c* is large, reduction in weight of the crown portion, for example, may not be expected. In view of the above, the width W of the thickness transition portion 4*c* is preferably in a range of not more than 10 mm, more preferably not more than 8 mm.

In the plan view of the head, the thickness transition portion 4*c* preferably has an arc shape protruding toward the toe T side of the club head 1. In particular, the thickness transition portion 4*c* preferably has an arc shape having a radius R of curvature in a range of from 30 to 110 mm. The radius R is defined using the center line of the width of the thickness transition portion 4*c*.

Preferably, the thickness transition portion 4*c* is formed as either a single arc shape having an uniform radius or continuous arcs having a multiple arcs that are smoothly connected one another. Such an arc shape of the thickness transition portion 4*c* can be curved in a similar manner as the contour of amplitude of the vibration of the crown portion 4 under the primary natural vibration mode of the club head 1. Accordingly, the configuration of the crown portion 4 which easily vibrates to produce low pitch hitting sound may be offered.

In the plan view of the head, the thickness transition portion 4*c* is preferably located in the toe side of the center G of gravity of the head. That is, the center G of gravity of the head is located within the heel-side portion 4*a* in the plan view of the head. Thus the heel-side portion 4*a* may have an area greater than that of the toe-side portion 4*b*, thereby producing low pitch and quiet hitting sound due to reducing amplitude of the crown portion.

In order to further improve the hitting sound, the ratio Ah/At of the area Ah of the heel-side portion 4*a* to the area Ah of the toe-side portion 4*b* is preferably not less than 0.70, more preferably not less than 1.00, still further preferably not less than 1.20, but preferably not more than 5.00 more preferably not more than 4.80.

In addition, when the area of the heel-side portion 4*a* is small with respect to the area of the crown portion 4, sufficient improvement effect for the hitting sound may not be expected. In view of the above, the area of the heel-side portion 4*a* having a relatively greater thickness is preferably not less than 25%, more preferably not less than 33% of the whole area Ac of the crown portion 4 in the plan view of the head.

Here, the respective areas are meant as the respective flat areas that are projected onto the horizontal plane HP. In addition, the whole area of the crown portion 4 is meant as the area calculated by subtracting the heel area including the hosel portion 7 from the area surrounded by the outline 1E of the head, as shown in FIG. 2. The heel area is defined as the hatching area located inside the circle having a radius r of 15 millimeters by centering on the center point CP of the shaft insertion hole in the plan view of the head.

Figure 6:
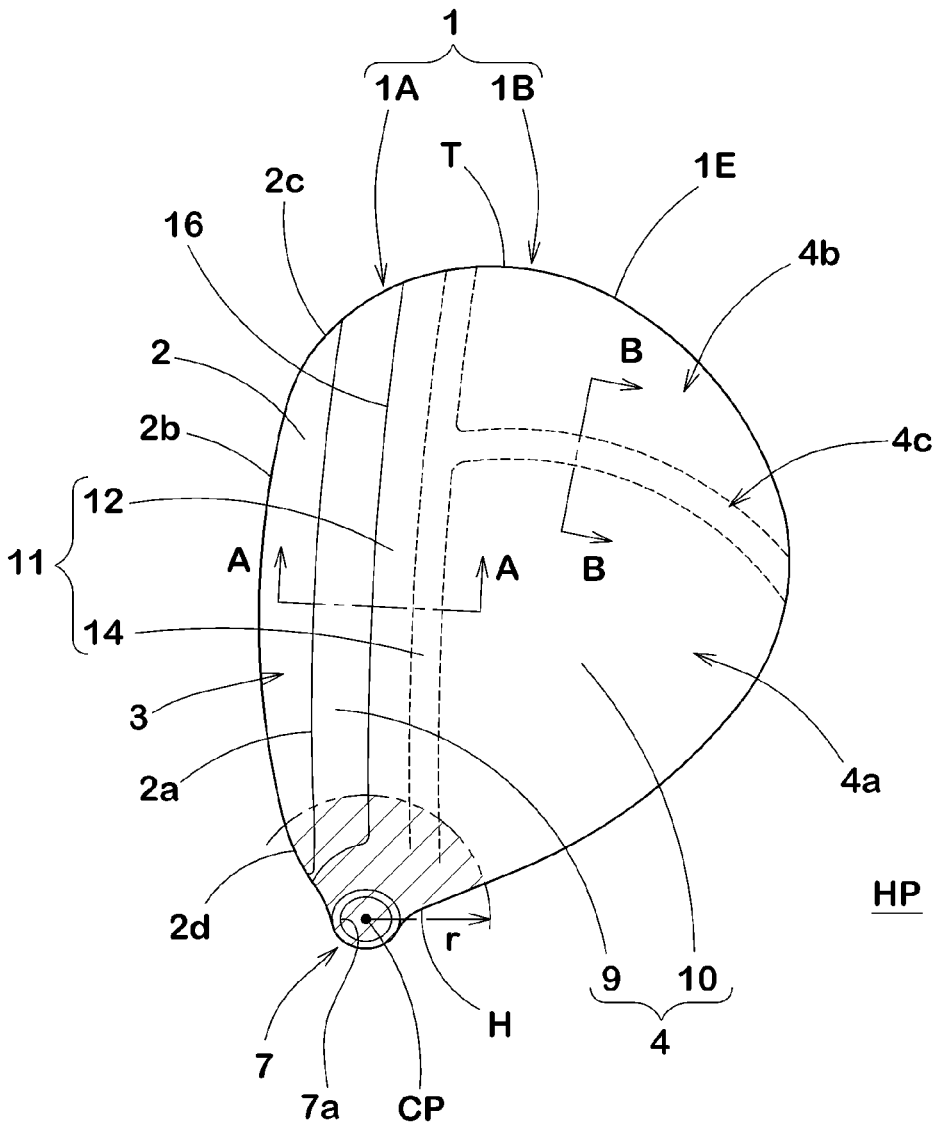
FIG. 6 is a plan view of the wood-type golf club head under the standard condition in accordance with another aspect of the invention.
Figure 7A:
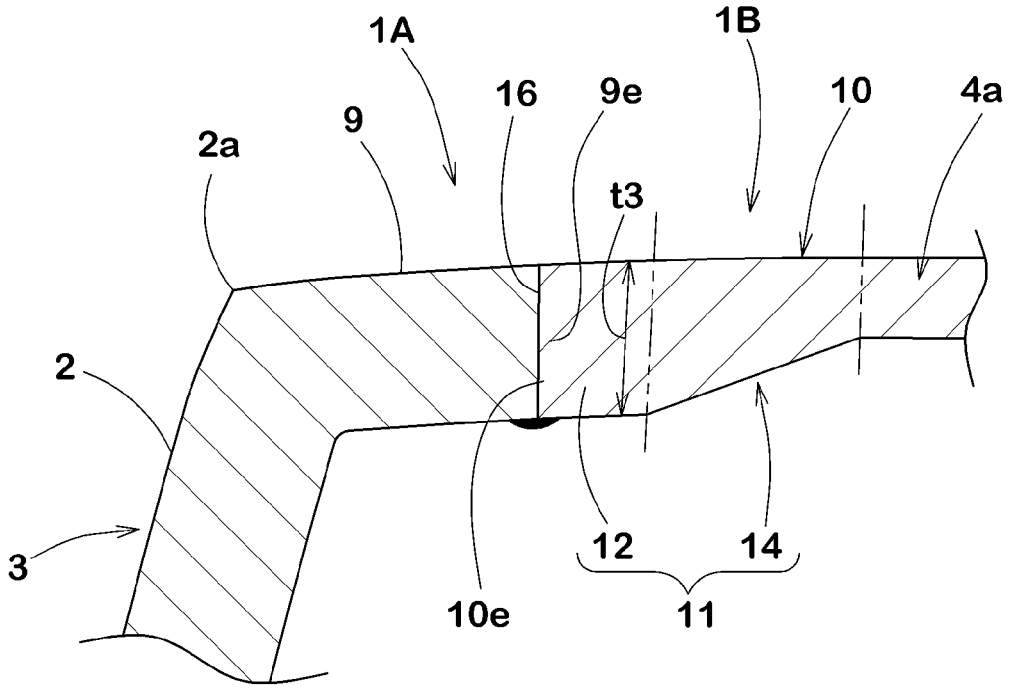
FIG. 7A is a cross sectional view taken along a line A-A of FIG. 6.
Figure 7B:
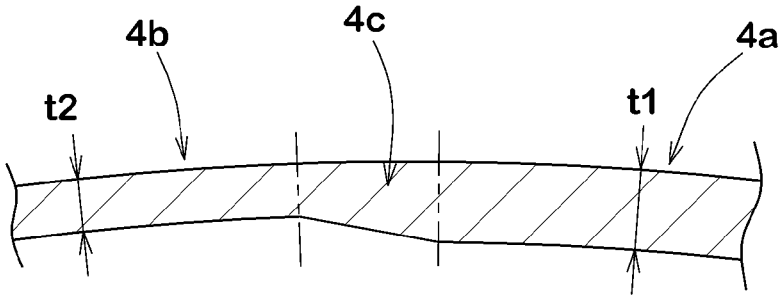
FIG. 7B is a cross sectional view taken along a line B-B of FIG. 6.

FIGS. 6 and 7 illustrate another embodiment of the invention. FIG. 6 is a plan view of the wood-type golf club head under the standard condition in accordance with another aspect of the invention, and FIG. 7A is a cross sectional view taken along a line A-A of FIG. 6, and FIG. 7B is a cross sectional view taken along a line B-B of FIG. 6. In this embodiment, the club head 1 comprises a face member 1A and a head main body 1B. These are made of metallic material, and one has different specific gravity to the other. For example, the face member 1A is made of a titanium alloy, and the head main body 1B is made of maraging steel having specific gravity greater than that of the face member 1A.

The face member 1A comprises a face 2, and a flange 9 extending rearwardly from the upper edge 2*a* of the face 2 at least. Although the details are not shown, the face member 1A has a cup-like shape having an annularly continuous flange 9 that extends from the upper edge 2*a*, the lower edge 2*b*, the toe-side edge 2*c* and the heel-side edge 2*d* of the face 2. In this disclosure, the front side with respect to the club head 1 means the side of the face 2, and the rear side with respect to the club head 1 means an opposite side (far side) from the face 2.

The head main body 1B, at least, comprises a crown rear portion 10 forming a major rear part of the crown portion 4, a sole rear portion (not shown) forming a rear major part of the sole portion 5, and a rear side portion (not shown) forming a rear major part of the side portion 6.

As shown in FIG. 7A, the front end 10*e* of the crown rear portion 10 of the head main body 1B is fixed to the rear end 9*e* of the flange 9 of the face member 1A by welding or brazing. That is, the crown portion 4 of the club head 1 in accordance with the present embodiment is composed of the flange 9 and the crown rear portion 10.

In order to ensure strength of the junction 16 between the front periphery 11 of the crown rear portion 10 and the flange 9, the front periphery 11 of the crown rear portion 10 comprises a base portion 12 extending from the front end 10*e* with a constant thickness and tapered portion 14 having a thickness gradually decreasing from the base portion 12 to either the heel-side portion 4*a* or the toe-side portion 4*b*.

In order to ensure strength of the junction 16 when welding to the rear end 9*e* of the flange 9, the thickness t3 of the base portion 12 is set greater than that of the heel-side portion 4*a*. Preferably, the thickness t3 is in a range of from 0.9 to 2.0 mm, for example.

The tapered portion 14, as shown in FIG. 6, extends in a toe-heel direction along the junction 16 in the plan view of the head. Since the respective flange 9 and the front periphery 11 of the crown rear portion 10 have relatively large thicknesses, they have little affect on the hitting sound. Thus, the heel-side portion 4*a* and the toe-side portion 4*b* of the crown portion 4 are arranged rearward of the tapered portion 14 in this embodiment.

In this embodiment, the thickness transition portion 4*c*, in the plan view of the head, divides the crown rear portion 10 (it exactly means the rear part of the tapered portion 14) of the head main body 1B into two portions of the heel-side portion 4*a* and the toe-side portion 4*b*. That is, one end of the thickness transition portion 4*c* is positioned on the front side of the crown rear portion 10, and the other end of the thickness transition portion 4*c* is positioned on the rear side of the crown rear portion 10. As compared to the embodiment shown in FIGS. 1 to 5, although the club head in accordance with the present embodiment has small area of the heel-side portion 4*a* and the toe-side portion 4*b*, the club head 1 may sufficiently produce low pitch and quiet hitting sound. In this embodiment, the heel-side portion 4*a*, the toe-side portion 4*b* and the thickness transition portion 4*c* are formed of the same metallic material.

While the particularly preferable embodiments of the pneumatic tire in accordance with the present invention have been described in detail, the present invention is not limited to the illustrated embodiments, but can be modified and carried out in various aspects.

[Comparison Test]

In order to confirm advantage of the present invention, wood-type golf club heads were manufactured based on Table 1 and measured these hitting sound and sweet spot height. The test method and major common specifications of the examples and references are as follows.

Figure 13A:
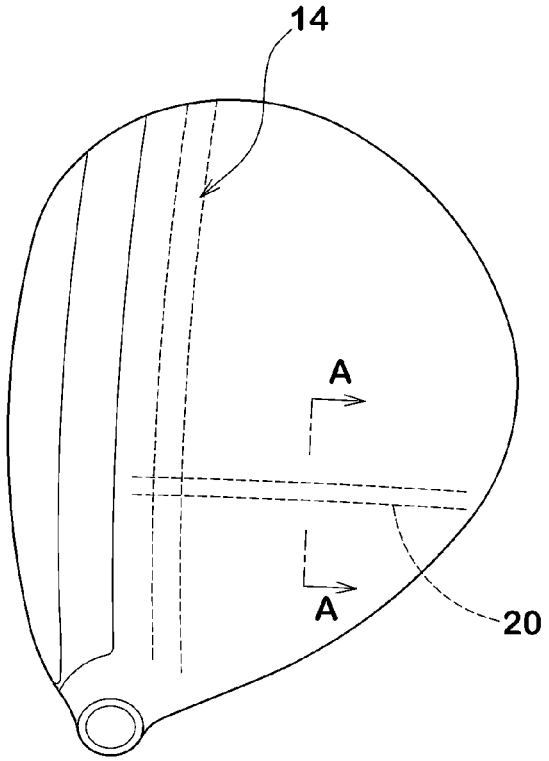
FIG. 13*a* is a plan view of yet another wood-type golf club head.
Figure 13B:
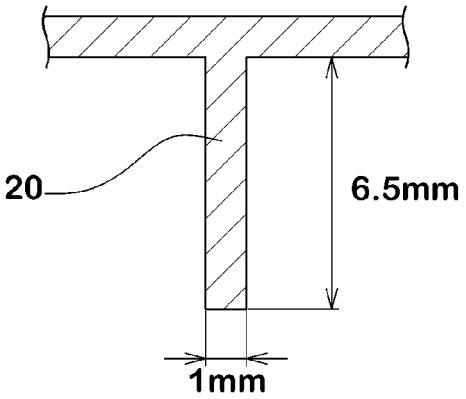
FIG. 13*b* is a cross sectional view of the head taken along lines A-A of FIG. 13*a*.

Head configuration: Cup-shaped face member and head main body (FIGS. 6 and 7)
Material of face member: Ti6-22-22S
Material of crown portion of head main body: CUSTOM450
Head volume: 150 $cm^3$
Head weight: 213 g
Head height (Reference sign "H" in FIG. 3): 36.4 mm
Face height: 30.6 mm
Loft angle: 18 deg.
Lie angle: 58.5 deg.
Hook angle: 0.5 deg.
Length of flange: 10 mm
Thickness of base portion of front periphery of crown rear portion: 1.7 mm
Width of base portion of front periphery of crown rear portion: 7 mm
Width of tapered portion of front periphery of crown rear portion: 5 mm The head of Ref. 4 is configured as shown in FIGS. 13A and 13B. The head has a basic configuration of FIG. 10 with a straightly extending rib 20 in the front-rear direction of the head. The rib 20 has a 1 mm width, a 6.5 mm height and a 60 mm long, and 3.0 g weight. The position of the rib in the Y-axis is minus ten (10) mm.

Sweet Spot Height:

As shown in FIG. 3, in the standard condition, the height SH to the sweet spot SS from the horizontal plane HP was measured as the sweet spot height.

Hitting Sound (Sensory Evaluation):

Ten of advanced golfers who have golf handicap of 5 to 15 and can hit a ball with a driver at speed of 45 m/s or more conducted actual hitting test in order to evaluate the hitting sound through their feeling by use of each test club. Each test club was manufactured by fitting the respective club heads with a golf club shaft having a 42 inches length and S-flex. Evaluation is a 5-point method, wherein the sound that gives excellent (low pitch and quiet) feeling was scored five points and the sound that gives badly (high pitch and loud) feeling was scored one point. The results are indicated as the average values of the evaluation of the ten golfers each of which is rounded off to whole numbers. The larger the value, the better the hitting sound is.

Sound Pressure and Frequency of Primary Natural Frequency of Hitting Sound:

Three-piece golf ball was hit by each of the above test golf clubs, and the hitting sound at that time was collected using the microphone and sound level meter produced by Rion Co. A frequency response function of the hitting sound was calculated using FFT analyzer (Ono Sokki Co. CF-4220, analysis software "Graduo") or the like, and then the sound pressure and the frequency of the primary natural frequency was read therefrom. The results are indicated using an index, wherein the sound pressure and frequency of Ref.1 is 100 respectively. The smaller the value, the smaller and lower the hitting sound is.

Center Coordinates (X, Y) of Thickness Transition Portion:

An X-Y coordinate system was defined on the head plan view under the standard condition as shown in FIGS. 8*a*-8*d* and FIGS. 9*a*-9*d*, wherein X-axis extends at right angles with respect to the vertical plane including the club shaft center line passing through the face center, and Y-axis extends at right angles with respect to X-axis passing through the intersection of the upper edge of the face and X-axis. Then, the coordinate values X and Y of the center C of the radius of curvature of the center line in the width direction of the thickness transition portion were sought.

Results of the tests are shown in Table 1. In Table 1, the mass of the transitional portion is calculated by equally distributing the toe-side portion and the heel-side portion.

TABLE 1

Figure 8A:
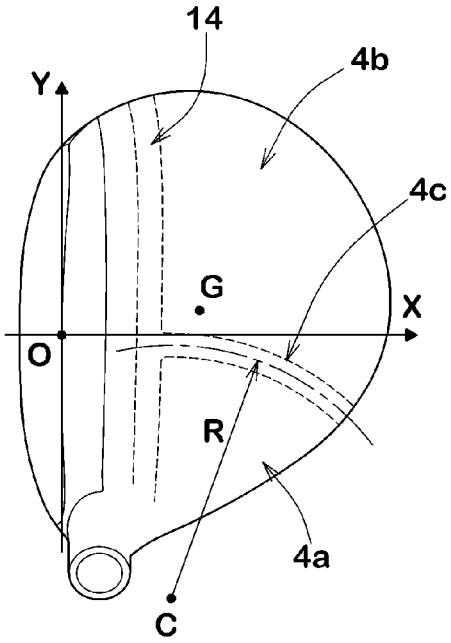
FIGS. 8*a* to 8*d* are plan views of the wood-type golf club heads in accordance with the present embodiments.
Figure 8C:
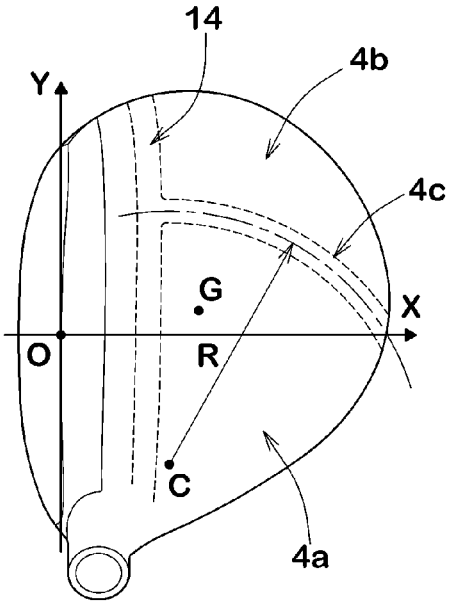
Figure 8B:
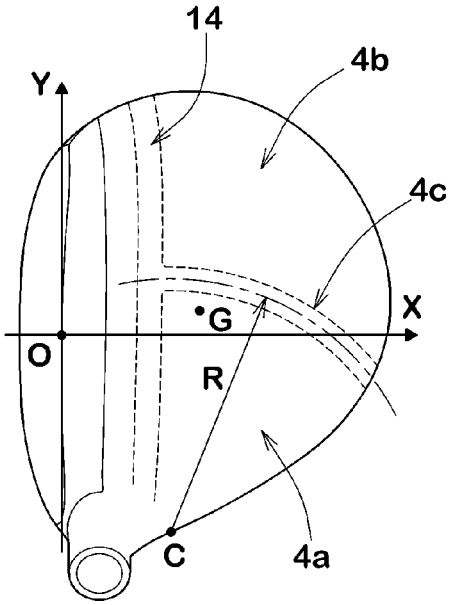
Figure 8D:
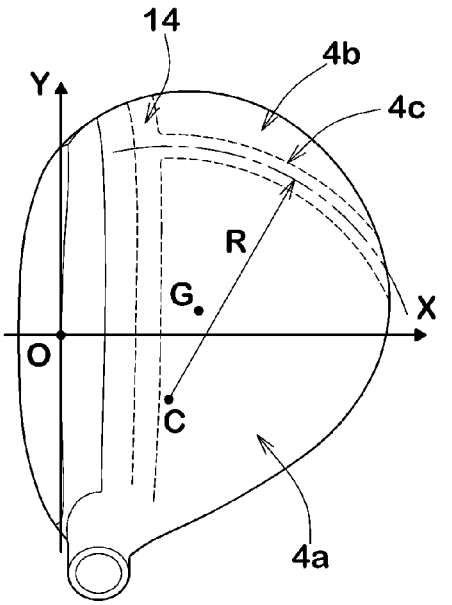
Figure 9A:
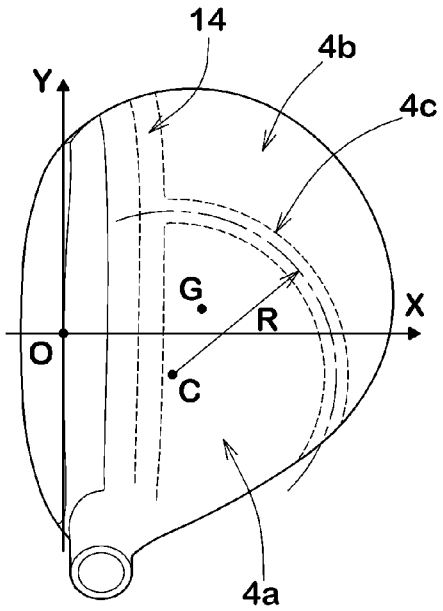
FIGS. 9*a* to 9*d* are plan views of the wood-type golf club heads in accordance with the present embodiments.
Figure 9C:
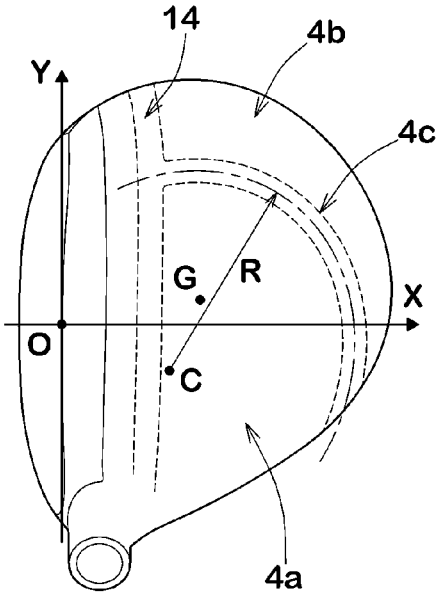
Figure 9B:
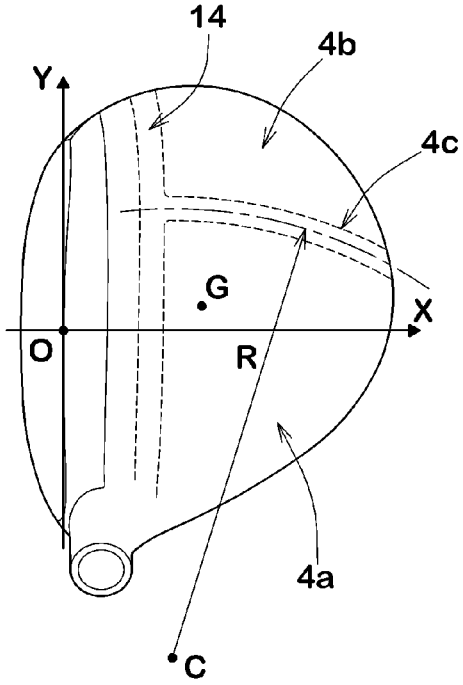
Figure 10:
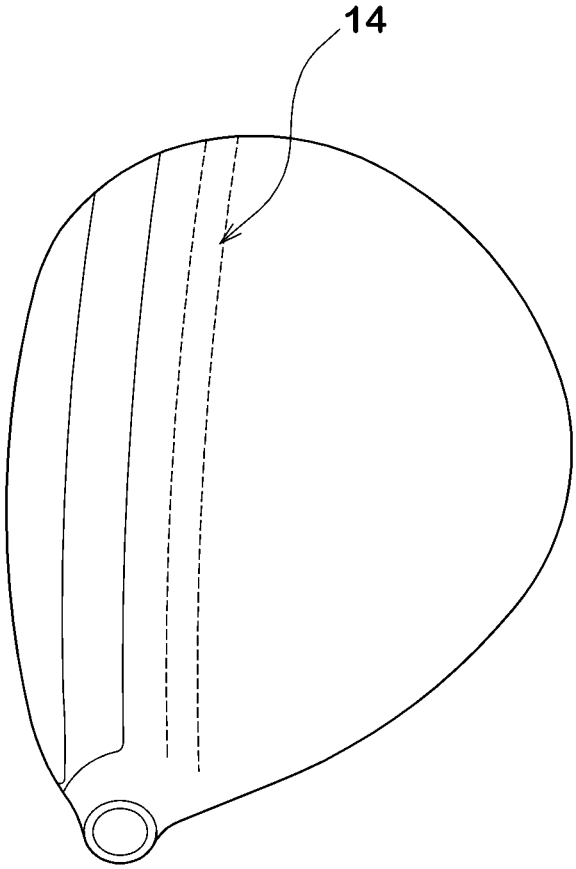
FIG. 10 is a plan view of a reference wood-type golf club head.
Figure 11:
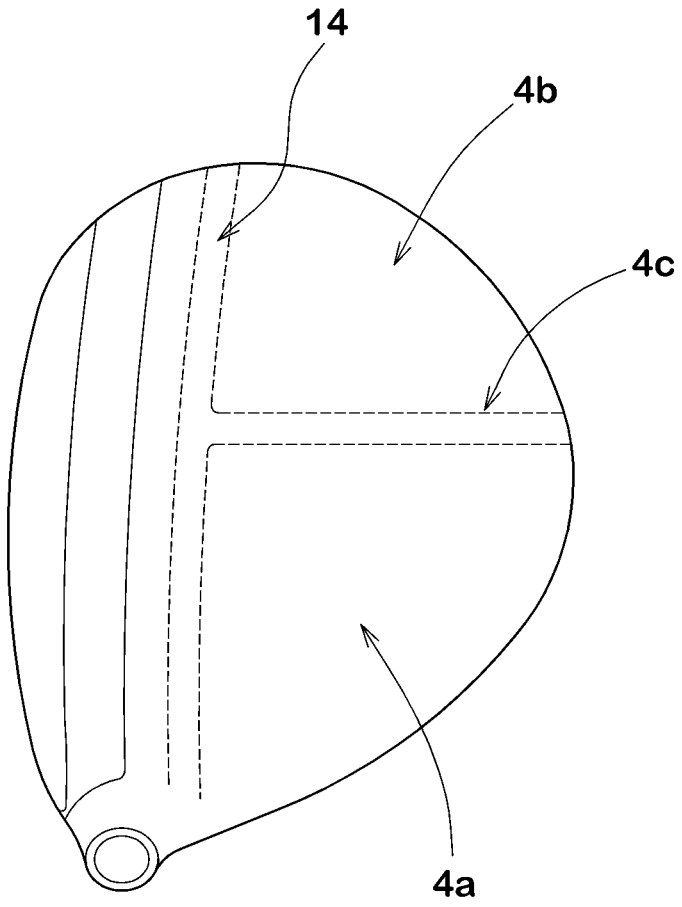
FIG. 11 is a plan view of another reference wood-type golf club head.
Figure 12:
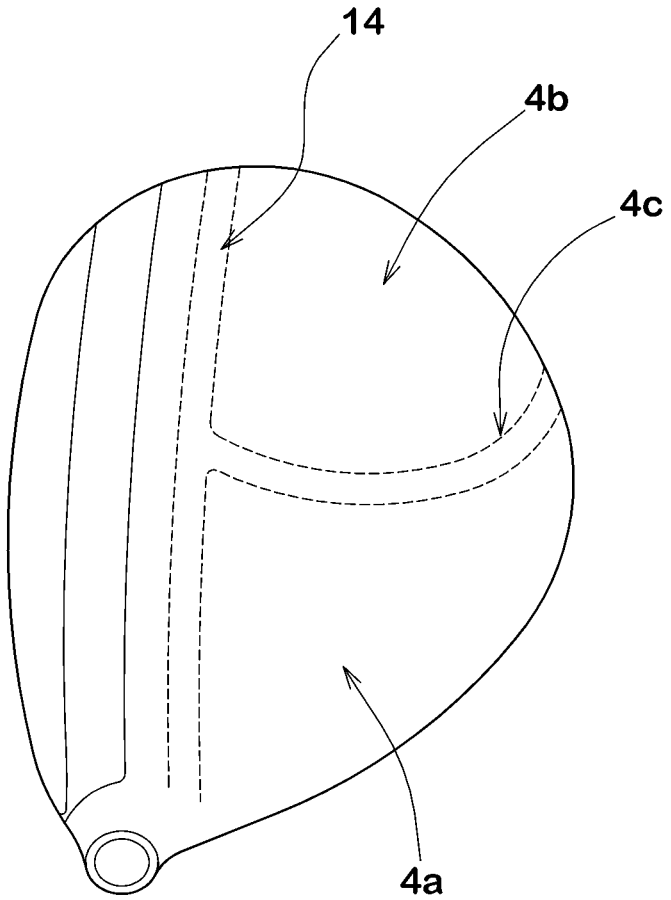
FIG. 12 is a plan view of yet another reference wood-type golf club head.

| | Ref. 1 | Ref. 2 | EX. 1 | EX. 2 | EX. 3 | EX. 4 | EX. 5 | EX. 6 | EX. 7 | EX. 8 | Ref. 3 |
|---|---|---|---|---|---|---|---|---|---|---|---|
| Crown portion configuration | FIG. 10 | FIG. 10 | FIG. 8a | FIG. 8b | FIG. 8b | FIG. 8c | FIG. 8d | FIG. 8c | FIG. 9a | FIG. 9b | FIG. 11 |
| Thickness transition portion shape | None | None | Arc | Arc | Arc | Arc | Arc | Arc | Arc | Arc | Straight |
| Center coordinate X of thickness transition portion (mm) | — | — | 25 | 25 | 25 | 25 | 25 | 25 | 25 | 25 | — |
| Center coordinate Y of thickness transition portion (mm) | — | — | −60 | −45 | −39 | −30 | −15 | −30 | −10 | −75 | — |
| Radius R of thickness transition portion (mm) | — | — | 57.5 | 57.5 | 57.5 | 57.5 | 57.5 | 57.5 | 37.5 | 102.5 | — |
| Width W of thickness transition portion (mm) | — | — | 5 | 5 | 5 | 5 | 5 | 5 | 5 | 5 | 5 |
| Thickness t1 of heel-side portion (mm) | 0.8 | 0.75 | 0.8 | 0.8 | 0.8 | 0.8 | 0.8 | 0.9 | 0.8 | 0.8 | 0.8 |
| Thickness t2 of toe-side portion (mm) | 0.8 | 0.75 | 0.65 | 0.65 | 0.65 | 0.65 | 0.65 | 0.5 | 0.65 | 0.65 | 0.65 |
| Area Ah of heel-side portion ($mm^2$) | 3750 | 3750 | 1150 | 1600 | 2050 | 2450 | 3100 | 2450 | 2200 | 2600 | 2750 |
| Area At of toe-side portion ($mm^2$) | — | — | 2600 | 2150 | 1700 | 1300 | 650 | 1300 | 1550 | 1150 | 1000 |
| Ratio Ah/At | — | — | 0.44 | 0.74 | 1.2 | 1.88 | 4.77 | 1.88 | 1.42 | 2.26 | 2.75 |
| Mass of heel-side portion (g) | 23.4 | 21.9 | 7.2 | 10 | 12.8 | 15.3 | 19.3 | 17.2 | 13.7 | 16.2 | 17.2 |
| Mass of toe-side portion (g) | 0 | 0 | 13.2 | 10.9 | 8.6 | 6.6 | 3.3 | 5.1 | 7.9 | 5.8 | 5.1 |
| Mass of rib (g) | 0 | 0 | 0 | 0 | 0 | 0 | 0 | 0 | 0 | 0 | 0 |
| Total mass of toe-side portion, heel-side portion and rib (g) | 23.4 | 21.9 | 20.4 | 20.9 | 21.4 | 21.9 | 22.6 | 22.3 | 21.6 | 22.1 | 22.2 |
| Sweet spot height (mm) | 24.3 | 24 | 23.7 | 23.8 | 23.9 | 24 | 24.1 | 24.1 | 23.9 | 24 | 24.1 |
| Sound pressure of primary natural vibration (Index) | 100 | 102 | 100 | 99 | 98 | 98 | 99 | 97 | 99 | 99 | 102 |
| Frequency of primary natural vibration (Index) | 100 | 102 | 99 | 98 | 97 | 96 | 98 | 97 | 98 | 98 | 104 |
| Hitting sound feeling test (Five point method) | 3 | 2 | 3 | 4 | 4 | 5 | 4 | 5 | 4 | 4 | 2 |

Figure 9D:
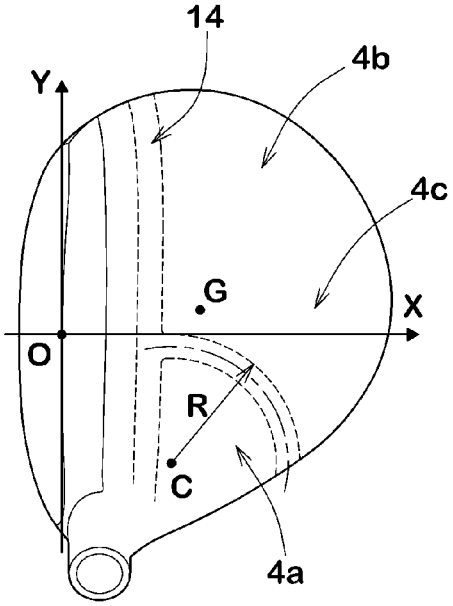

| | Ref. 4 | EX. 9 | Ref. 5 | EX. 10 | EX. 11 | EX. 12 | EX. 13 | EX. 14 | EX. 15 | EX. 16 | EX. 17 | EX. 18 |
|---|---|---|---|---|---|---|---|---|---|---|---|---|
| Crown portion configuration | FIG. 13 | FIG. 9c | FIG. 8c | FIG. 8c | FIG. 8b | FIG. 8c | FIG. 8a | FIG. 8c | FIG. 8c | FIG. 8c | FIG. 9d | FIG. 9b |
| Thickness transition portion shape | None | Ellipse | Arc | Arc | Arc | Arc | Arc | Arc | Arc | Arc | Arc | Arc |
| Center coordinate X of thickness transition portion (mm) | — | 25 | 25 | 25 | 25 | 25 | 25 | 25 | 25 | 25 | 25 | 25 |
| Center coordinate Y of thickness transition portion (mm) | — | −10 | −30 | −30 | −39 | −30 | −60 | −30 | −30 | −30 | −30 | −82.5 |
| Radius R of thickness transition portion (mm) | — | Vary | 57.5 | 57.5 | 57.5 | 57.5 | 57.5 | 57.5 | 57.5 | 57.5 | 30 | 110 |
| Width W of thickness transition portion (mm) | — | 5 | 5 | 5 | 5 | 5 | 5 | 2 | 10 | 15 | 5 | 5 |
| Thickness t1 of heel-side portion (mm) | 0.65 | 0.8 | 0.7 | 0.6 | 1.1 | 0.9 | 0.95 | 0.8 | 0.8 | 0.8 | 0.8 | 0.8 |
| Thickness t2 of toe-side portion (mm) | 0.65 | 0.65 | 0.85 | 0.55 | 0.3 | 0.3 | 0.9 | 0.65 | 0.65 | 0.65 | 0.65 | 0.65 |
| Area Ah of heel-side portion ($mm^2$) | 3750 | 2750 | 2450 | 2450 | 2050 | 2450 | 1150 | 2450 | 2450 | 2450 | 950 | 2610 |
| Area At of toe-side portion ($mm^2$) | — | 1000 | 1300 | 1300 | 1700 | 1300 | 2600 | 1300 | 1300 | 1300 | 2800 | 1140 |
| Ratio Ah/At | — | 2.75 | 1.88 | 1.88 | 1.2 | 1.88 | 0.44 | 1.88 | 1.88 | 1.88 | 0.34 | 2.29 |
| Mass of heel-side portion (g) | 19 | 17.2 | 13.4 | 11.5 | 12.8 | 17.2 | 8.5 | 15.3 | 15.3 | 15.3 | 5.9 | 16.3 |
| Mass of toe-side portion (g) | 0 | 5.1 | 8.6 | 5.6 | 8.6 | 3 | 18.3 | 6.6 | 6.6 | 6.6 | 14.2 | 5.8 |
| Mass of rib (g) | 3 | 0 | 0 | 0 | 0 | 0 | 0 | 0 | 0 | 0 | 0 | 0 |
| Total mass of toe-side portion, heel-side portion and rib (g) | 22 | 22.2 | 22 | 17 | 21.4 | 20.2 | 26.8 | 21.9 | 21.9 | 21.9 | 20.1 | 22.1 |
| Sweet spot height (mm) | 24 | 24.1 | 24 | 23 | 23.9 | 23.7 | 24.9 | 24 | 24 | 24.1 | 23.7 | 24 |
| Sound pressure of primary natural vibration (Index) | 108 | 98 | 106 | 100 | 96 | 97 | 97 | 98 | 99 | 99 | 100 | 100 |
| Frequency of primary natural vibration (Index) | 104 | 96 | 98 | 99 | 100 | 98 | 97 | 98 | 96 | 98 | 99 | 99 |
| Hitting sound feeling test (Five point method) | 1 | 5 | 2 | 3 | 4 | 4 | 5 | 4 | 4 | 4 | 3 | 3 |

Whole area Ac of crown portion: 5700 $mm^2$

From the results, it was confirmed that the example club heads had produced low pitch and quiet hitting sound maintaining a low sweet spot height.

DESCRIPTION OF THE REFERENCE NUMERALS

1 Wood-type golf club head
2 Face
3 Face portion
4 Crown portion
4*a* Heel-side portion
4*b* Toe-side portion
4*c* Thickness transition portion
5 Sole portion
6 Side portion

The invention claimed is:

1. A wood-type golf club head having a hollow therein, the club head comprising:

a crown portion forming a top surface of the head and being made of metallic material;

the crown portion comprising a heel-side portion, a toe-side portion having a thickness smaller than that of the heel-side portion and a thickness transition portion provided between the toe-side portion and the heel-side portion and having a thickness gradually decreasing from the heel-side portion to the toe-side portion; and the thickness transition portion extending in a curved manner that smoothly protrudes toward a toe of the club head in a plan view of the club head under a standard condition in which the club head is placed on a horizontal plane with its lie angle and its loft angle, wherein the thickness transition portion is located in a toe side of a center of gravity of the head in the plan view.

2. The wood-type golf club head according to claim 1, wherein the thickness transition portion extends in an arc shape in the plan view.

3. The wood-type golf club head according to claim 1, wherein the heel-side portion has a thickness t1 in a range of from 0.6 to 1.1 mm, and the toe-side portion has a thickness t2 in a range of from 0.3 to 0.9 mm.

4. The wood-type golf club head according to claim 1, wherein the difference t1−t2 between a thickness t1 of the heel-side portion and a thickness t2 of the toe-side portion is in a range of from 0.05 to 0.8 mm.

5. The wood-type golf club head according to claim 1, wherein the thickness transition portion has a width in a range of from 2 to 10 mm in the plan view.

6. The wood-type golf club head according to claim 1, wherein the thickness transition portion extends in an arc manner having a radius of curvature in a range of from 30 to 110 mm in the plan view.

7. The wood-type golf club head according to claim 1, wherein a ratio Ah/At of an area Ah of the heel-side portion to an area At of the toe-side portion is in a range of from 0.70 to 5.0.

8. A wood-type golf club head having a hollow therein, the club head comprising:

a crown portion forming a top surface of the head and being made of metallic material;

the crown portion comprising a heel-side portion, a toe-side portion having a thickness smaller than that of the heel-side portion and a thickness transition portion provided between the toe-side portion and the heel-side portion and having a thickness gradually decreasing from the heel-side portion to the toe-side portion; and the thickness transition portion extending in a curved manner that smoothly protrudes toward a toe of the club head in a plan view of the club head under a standard condition in which the club head is placed on a horizontal plane with its lie angle and its loft angle, wherein the thickness transition portion has a width in a range of from 2 to 10 mm in the plan view.

9. The wood-type golf club head according to claim 8, wherein the thickness transition portion extends in an arc shape in the plan view.

10. The wood-type golf club head according to claim 8, wherein the heel-side portion has a thickness t1 in a range of from 0.6 to 1.1 mm, and the toe-side portion has a thickness t2 in a range of from 0.3 to 0.9 mm.

11. The wood-type golf club head according to claim 8, wherein the difference t1−t2 between a thickness t1 of the heel-side portion and a thickness t2 of the toe-side portion is in a range of from 0.05 to 0.8 mm.

12. The wood-type golf club head according to claim 8, wherein the thickness transition portion extends in an arc manner having a radius of curvature in a range of from 30 to 110 mm in the plan view.

13. The wood-type golf club head according to claim 8, wherein a ratio Ah/At of an area Ah of the heel-side portion to an area At of the toe-side portion is in a range of from 0.70 to 5.0.

14. A wood-type golf club head having a hollow therein, the club head comprising:

a crown portion forming a top surface of the head and being made of metallic material;

the crown portion comprising a heel-side portion, a toe-side portion having a thickness smaller than that of the heel-side portion and a thickness transition portion provided between the toe-side portion and the heel-side portion and having a thickness gradually decreasing from the heel-side portion to the toe-side portion; and the thickness transition portion extending in a curved manner that smoothly protrudes toward a toe of the club head in a plan view of the club head under a standard condition in which the club head is placed on a horizontal plane with its lie angle and its loft angle, wherein the thickness transition portion extends in an arc manner having a radius of curvature in a range of from 30 to 110 mm in the plan view.

15. The wood-type golf club head according to claim 8, wherein the thickness transition portion extends in an arc shape in the plan view.

16. The wood-type golf club head according to claim 8, wherein the heel-side portion has a thickness t1 in a range of from 0.6 to 1.1 mm, and the toe-side portion has a thickness t2 in a range of from 0.3 to 0.9 mm.

17. The wood-type golf club head according to claim 8, wherein the difference t1−t2 between a thickness t1 of the heel-side portion and a thickness t2 of the toe-side portion is in a range of from 0.05 to 0.8 mm.

18. The wood-type golf club head according to claim 8, wherein a ratio Ah/At of an area Ah of the heel-side portion to an area At of the toe-side portion is in a range of from 0.70 to 5.0.

19. A wood-type golf club head having a hollow therein, the club head comprising:

a crown portion forming a top surface of the head and being made of metallic material;

the crown portion comprising a heel-side portion, a toe-side portion having a thickness smaller than that of the heel-side portion and a thickness transition portion provided between the toe-side portion and the heel-side portion and having a thickness gradually decreasing from the heel-side portion to the toe-side portion; and the thickness transition portion extending in a curved manner that smoothly protrudes toward a toe of the club head in a plan view of the club head under a standard condition in which the club head is placed on a horizontal plane with its lie angle and its loft angle, wherein a ratio Ah/At of an area Ah of the heel-side portion to an area At of the toe-side portion is in a range of from 0.70 to 5.0.

20. The wood-type golf club head according to claim 8, wherein the thickness transition portion extends in an arc shape in the plan view.

21. The wood-type golf club head according to claim 8, wherein the heel-side portion has a thickness t1 in a range of from 0.6 to 1.1 mm, and the toe-side portion has a thickness t2 in a range of from 0.3 to 0.9 mm.

22. The wood-type golf club head according to claim 8, wherein the difference t1–t2 between a thickness t1 of the heel-side portion and a thickness t2 of the toe-side portion is in a range of from 0.05 to 0.8 mm.

* * * * *